US010689186B2

(12) United States Patent
Viestenz et al.

(10) Patent No.: US 10,689,186 B2
(45) Date of Patent: Jun. 23, 2020

(54) PACK FOR CIGARETTES

(71) Applicant: Focke & Co. (GmbH & Co. KG), Verden (DE)

(72) Inventors: Kristina Viestenz, Verden (DE); Corvyn Sommer, Verden (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 0 days.

(21) Appl. No.: 16/316,507

(22) PCT Filed: Aug. 9, 2017

(86) PCT No.: PCT/EP2017/000964
§ 371 (c)(1),
(2) Date: Jan. 9, 2019

(87) PCT Pub. No.: WO2018/036648
PCT Pub. Date: Mar. 1, 2018

(65) Prior Publication Data

US 2019/0300274 A1 Oct. 3, 2019

(30) Foreign Application Priority Data

Aug. 23, 2016 (DE) ..... 10 2016 115 594
Oct. 27, 2016 (DE) ..... 10 2016 120 506

(51) Int. Cl.
*B65D 85/10* (2006.01)

(52) U.S. Cl.
CPC ..... *B65D 85/1054* (2013.01); *B65D 85/1018* (2013.01); *B65D 85/1045* (2013.01); *B65D 85/1081* (2013.01)

(58) Field of Classification Search
CPC ..... B65D 85/10; B65D 85/1018; B65D 85/1045; B65D 85/1054; B65D 85/1081
(Continued)

(56) References Cited

U.S. PATENT DOCUMENTS 3,752,307 A 8/1973 German
5,480,025 A 1/1996 Draucker
(Continued)

FOREIGN PATENT DOCUMENTS

DE 102014222994 A1 3/2016
GB 507998 A 6/1939
(Continued)

OTHER PUBLICATIONS

WIPO, International Search Report (on priority application), dated Oct. 27, 2017.
(Continued)

*Primary Examiner* — Bryon P Gehman
(74) *Attorney, Agent, or Firm* — Laurence P. Colton; Smith Tempel Blaha LLC

(57) ABSTRACT

A pack for a group of rod-shaped articles, having a box part, which is delimited at least by a front wall, a rear wall, side walls and a base wall, the box part containing a collar, at least comprising a collar front wall, which butts against the front wall of the box part, and collar side walls, which are adjacent to side walls of the box part, and at least one base flap arranged in extension of the collar front wall and, forming an underside support for at least one group of rod-shaped articles, the collar serving to compensate for at least one different dimension of the group of rod-shaped articles.

5 Claims, 7 Drawing Sheets

(58) Field of Classification Search
USPC ..... 206/256, 258, 268
See application file for complete search history.

(56) References Cited

U.S. PATENT DOCUMENTS

| | | | | |
|---|---|---|---|---|
| 6,412,630 | B2 * | 7/2002 | Focke | B65D 85/1081 206/268 |
| 7,832,556 | B2 * | 11/2010 | Ghini | B65D 85/1045 206/256 |
| 2009/0242434 | A1 | 10/2009 | Ghini | |

FOREIGN PATENT DOCUMENTS

| | | | |
|---|---|---|---|
| WO | 2011060795 | A1 | 5/2011 |
| WO | 2015015399 | A1 | 2/2015 |
| WO | 2016001123 | A1 | 1/2016 |
| WO | 2016005914 | A1 | 1/2016 |
| WO | 2016005949 | A1 | 1/2016 |
| WO | 2016103208 | A1 | 6/2016 |

OTHER PUBLICATIONS

Deutsches Patent—UND Markenamt (German Patent and Trademark Office), Recherchenbericht (search in a related application), Apr. 4, 2017.

* cited by examiner

VII
VIII
10
11
12
13
14
15
16
17
18
19
20
21
22
23
24
25
26
27
28
29
30
31
32
37
39
40
41
42
46
49

10
11
13
14
15
16
20
22
23
26
27
28
31
51
53
54
55
56
57
60
61
62
63
XIV
XV
XVI

PACK FOR CIGARETTES

CROSS REFERENCE TO RELATED APPLICATIONS

This patent application is the US PCT National Phase of International Application No. PCT/EP2017/000964 having an International Filing Date of 9 Aug. 2017, which claims priority on German Patent Application No. 10 2016 115 594.2 having a filing date of 23 Aug. 2016 and German Patent Application No. 10 2016 120 506.0 having a filing date of 27 Oct. 2016.

BACKGROUND OF THE INVENTION

Technical Field

The invention relates to a pack for cigarettes or rod-shaped objects, having a box part which is delimited by at least one front wall, one rear wall, side walls and one bottom wall, wherein the box part serves for receiving at least one cuboid cigarette group or group of rod-shaped objects preferably wrapped in an inner blank and wherein the pack comprises predefined dimensions with regard to the width, the depth and the height and at least one dimension of the at least one cigarette group or of the group of rod-shaped objects is smaller than a corresponding dimension of the interior of the box part so that the at least one cigarette group or the group of rod-shaped objects does not fill out the interior of the box part with reference to the at least one dimension, and wherein a collar is arranged in the box part, consisting of at least one collar front wall, which abuts against the front wall of the box part, and collar side walls which are arranged adjacent to side walls of the box part.

Prior Art

The pack sizes or the dimensions of packs for cigarettes may be predefined for various reasons in practice, for example for legal, fiscal or technical reasons. In order to ensure that packs are produced in a cost-efficient manner, however, it is desirable for the pack, with constant (outer) dimensions, to be able to be filled with different contents in order to be able to react flexibly to corresponding defaults in various markets without any costly conversion of the packing machine being necessary. In particular, it is of benefit to accommodate a smaller number of cigarettes or cigarette groups or rod-shaped objects or groups of rod-shaped objects with smaller dimensions in usual packs.

BRIEF SUMMARY OF THE INVENTION

Against said background, the object underlying the invention is to develop packs for cigarettes further, in particular with regard to receiving different pack contents in as advantageous a manner as possible in preferably standardized packs.

A pack to achieve said object is a pack for cigarettes or rod-shaped objects, having a box part which is delimited by at least one front wall, one rear wall, side walls and one bottom wall, wherein the box part serves for receiving at least one cuboid cigarette group or group of rod-shaped objects preferably wrapped in an inner blank and wherein the pack comprises predefined dimensions with regard to the width, the depth and the height and at least one dimension of the at least one cigarette group or of the group of rod-shaped objects is smaller than a corresponding dimension of the interior of the box part so that the at least one cigarette group or the group of rod-shaped objects does not fill out the interior of the box part with reference to the at least one dimension, and wherein a collar is arranged in the box part, consisting of at least one collar front wall, which abuts against the front wall of the box part, and collar side walls which are arranged adjacent to side walls of the box part, characterized in that at least one bottom flap, which extends directed transversely to the collar front wall as bottom-side support of the at least one cigarette group or group of rod-shaped objects, is arranged as an extension of the collar front wall so that the collar serves for compensating for at least one different dimension of the cigarette group or group of rod-shaped objects. It is accordingly provided that at least one bottom flap, which extends directed transversely to the collar front wall as bottom-side support of the at least one cigarette group or group of rod-shaped objects, is arranged as an extension of the collar front wall so that the collar serves for compensating for at least one different dimension of the cigarette group or group of rod-shaped objects.

In this way, it is possible to reduce the interior of the box part with regard to the cigarette block being smaller in height. As it is preferably only necessary to adapt the collar when adapting to the or each smaller dimension, expenditure for converting the packing machines is minimized.

According to a preferred further development, it can be provided that the bottom flap is connected in an articulated manner to the collar front wall, in particular at a lower edge of the same, and that the bottom flap is held on the collar side walls in its position directed transversely to the collar front wall by at least one bearing element, in particular by bearing projections impressed in the material of the collar side walls.

The or each bottom flap is preferably held on the collar side walls by bearing projections at two of its opposite side walls.

It can additionally be provided that the or each cigarette group or group of rod-shaped objects comprises a shallower depth than the interior of the box part, and that said smaller dimension is compensated for by a filling piece which is arranged between the or each cigarette group or group of rod-shaped objects and a rear wall of the box part, it preferably being provided that the filling piece serves as bearing element for the bottom flap of the collar.

A further characteristic can consist in a front wall of the filling piece, abutting against the rear side of the or each cigarette group or group of rod-shaped objects, comprising a pivotable flap, wherein the bottom flap projects into an opening formed by the flap in the front wall and is supported on a horizontal edge of the opening.

The positional securement of the folded bottom flap can also be effected as a result of said bottom flap being supported at the bottom by collar support tabs which are folded out of the plane of the collar side walls into the region below the bottom flap.

In addition to this or as an alternative to it, it can be provided that the bottom flap is supported at the bottom by blank support tabs which are folded out of the plane of the side walls of the box part into the region below the bottom flap.

A further characteristic can consist in a support flap, which extends directed transversely to the bottom flap for abutment against the rear wall of the box part, being arranged as an extension of the bottom flap.

In a preferred further development of the invention, it can be provided that collar side walls are dimensioned in such a manner that the collar stands upright with the collar side walls on the bottom wall of the box part and the bottom flap is held in such a manner at the bearing projections that the or each cigarette group or group of rod-shaped objects projects out of the upwardly open box part for the removal of individual cigarettes.

It can be provided in a preferred exemplary embodiment that two cigarette groups or groups of rod-shaped objects are arranged in the box part at a lateral distance from one another, wherein the cigarette groups or groups of rod-shaped objects are held in their position by walls of the collar, and wherein each cigarette group or group of rod-shaped objects is surrounded by a collar front wall and in each case two collar side walls, and wherein a spacer is arranged between inner collar side walls which face on another, and wherein the outer collar side walls which are remote from one another abut against side walls of the box part, and wherein each cigarette group or group of rod-shaped objects is supported on the underside by a (separate) bottom flap, and wherein the bottom flaps are each held by two bearing projections on the inner collar side walls and in each case by one bearing projection on the outer collar side walls.

Outer collar side walls are preferably held by bearing projections which are formed on the side walls of the box part.

A further characteristic can consist in the filling piece being formed from a folded blank produced from packing material, and comprising a front wall, an upper end-face wall and side walls and, in particular, not comprising a rear wall or a bottom wall, and wherein the height of the filling piece corresponds substantially to the corresponding dimension of the box part so that the filling piece stands upright on a bottom wall of the box part, and wherein the pivotable flap for forming an opening with the bearing projection for the bottom flap is realized in the front wall of the filling piece.

It is preferably provided that the bottom flap extends substantially over the entire width of the interior of the box part below the or each cigarette group or group of rod-shaped objects.

It is additionally provided that the bottom flap extends substantially over the entire depth of the interior of the box part between the front wall of the box part and the rear wall of the same or of the front wall of the filling piece.

BRIEF DESCRIPTION OF THE DRAWINGS

Preferred exemplary embodiments of the invention are described below by way of the drawing, in which.

DETAILED DESCRIPTION OF PREFERRED EMBODIMENTS

Figures 1, 2, 3:
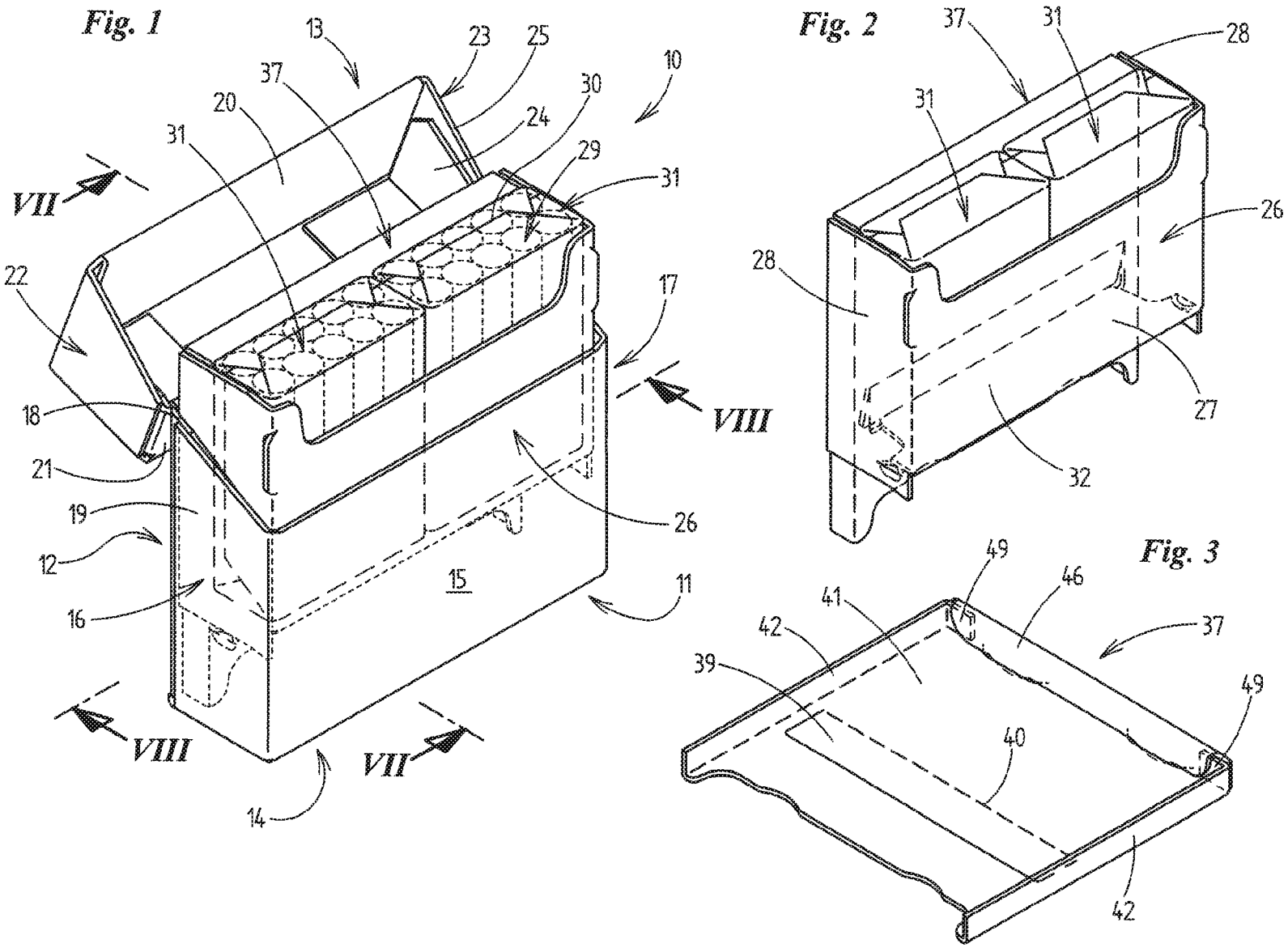
FIG. 1 shows a spatial representation of a pack for cigarettes with an open lid.
FIG. 2 shows a spatial representation of a pack content with filling piece and collar of the pack according to FIG. 1.
FIG. 3 shows a spatial representation of the filling piece, looking at the rear side.

The invention is described below by way of various exemplary embodiments which each refer to a pack 10 of the hinge-lid type for cigarettes. Reference is made explicitly to the fact that the invention can relate to other types of packs for cigarettes.

The packs 10 shown in the figures consist of a box part 11 and a lid 13 which is mounted in the region of a rear wall 12 of the box part 11 so as to be pivotable. The box part 11 consists additionally of a (lower) bottom wall 14 and an (upright) front wall 15 which is located opposite the rear wall 12. Side walls 16, 17 connect rear wall 12 and front wall 15 together and are formed from inner and outer side tabs 18, 19 which overlap one another. The lid 13 consists correspondingly of front wall 20, rear wall 21, end wall and side walls 22, 23. The side walls 22, 23 of the lid 13 are also formed by inner and outer side tabs 24, 25 which overlap one another.

A further component of the packs 10 is in each case a collar 26 in various configurations. Basic components of the collar 26, however, are always a collar front wall 27 which abuts against the front wall 15 of the box part 11 and, where applicable, is connected to said front wall by means of adhesion. In addition, collar side walls 28, which extend along side walls 16, 17 of the box part 11, are associated with the collar 26. An upper region of the collar 26, which projects out of the box part 11, is surrounded by the lid 13 with the pack 10 in the closed position.

The cuboid pack 10, realized in this manner and produced from thin cardboard, is particularly suited for receiving cigarettes or other rod-shaped objects. The cigarettes are formed as cigarette group 29 and are surrounded by an inner blank 30, for example produced from tin foil. A cigarette block 31 is thus created. It is also conceivable for the inner blank 30 to be formed from a film-like material so that the cigarette group 29 is able to be packed to form a sealed block. In the exemplary embodiments shown the cigarette group 29 or the cigarette block 31 is realized in a substantially cuboid manner, with a square or rectangular cross section. It is obvious that the cigarette group 29 or the cigarette block 31 can also comprise other cross-sectional forms, for example with a trapezoidal or triangular cross section. For reasons of linguistic simplification, the terms cigarette group or cigarette block are used synonymously for groups produced from rod-shaped objects or rod-shaped objects wrapped in an inner blank 30.

One special feature is with regard to the dimensions of the cigarette group 29 or of the cigarette block 31. The dimensions (width, height, depth) do not correspond, namely at least in part, to the corresponding dimensions of the interior of the box part 11 or of the pack 10 so that without countermeasures a cavity would be created, as a result of which the cigarette group 29 or the cigarette block 31 would not be held securely or correctly in the box part 11. In a corresponding manner, at least one dimension of the cigarette group 29 or of the cigarette block 31 is smaller than a corresponding dimension of the interior of the box part 11 or of the pack 10.

Insofar as it is maintained within the framework of said application that the dimensions (of cigarette group 29 or cigarette block 31 on the one hand and of the interior of the box part 11 or of the pack 10 on the other hand) are different, this does not refer to the usual deviations which are usually present in the course of measuring and production tolerances or for the purpose of removing the cigarettes in a simple manner, but to deviations which go beyond said measurement. The invention relates to deviations in the dimensions which are created as a result of one or multiple cigarette groups 29 or cigarette blocks 31 being used within the pack 10 which, on account of the number and/or the dimension of the cigarettes, have a smaller volume than is usual in the case of such packs 10, such that there are significant differences in the dimensions which have to be compensated for in a suitable manner in order to receive the cigarette group 29 or the cigarette block 31 securely in the pack 10 in spite of the deviating dimensions.

In the present case, the height of the cigarette groups 29 or the cigarette blocks 31 in all the exemplary embodiments is smaller than that of the interior of the box part 11. Correspondingly, the cigarettes are shorter than is normally the case.

In addition, in all the exemplary embodiments two cigarette groups 29 or cigarette blocks 31 are provided in each case as pack contents in each pack 10. The cigarette groups 29 or cigarette blocks 31 are arranged side by side, in part at a distance from one another. It is obvious that within the framework of the invention it is also possible to use packs 10 with only one cigarette group 29 or one cigarette block 31.

In all the exemplary embodiments, the cigarette groups 29 or cigarette blocks 31 are each realized in a matching manner, i.e. with identical dimensions and cigarette formations. This too does not have to be inevitably so. It is also conceivable, in particular, to have different pack contents in the two cigarette groups 29 or cigarette blocks 31.

In the first exemplary embodiment, the collar 26 is provided with a bottom flap 32 which supports the cigarette groups 29 or cigarette blocks 31 at the bottom. In this way, the smaller height of the cigarette groups 29 or cigarette blocks 31 is compensated for such that the top side of the cigarette groups 29 or cigarette blocks 31 is situated, as usual, approximately at the level of the top side of the collar 26.

The bottom flap 32 is connected to the collar front wall 27 in an articulated manner, for example by means of a line joint 33, as is also realized between the lid 13 and the box part 11. In this way, the bottom flap 32 extends as an extension of the collar front wall 27 or continues on the underside thereof.

Figure 5:
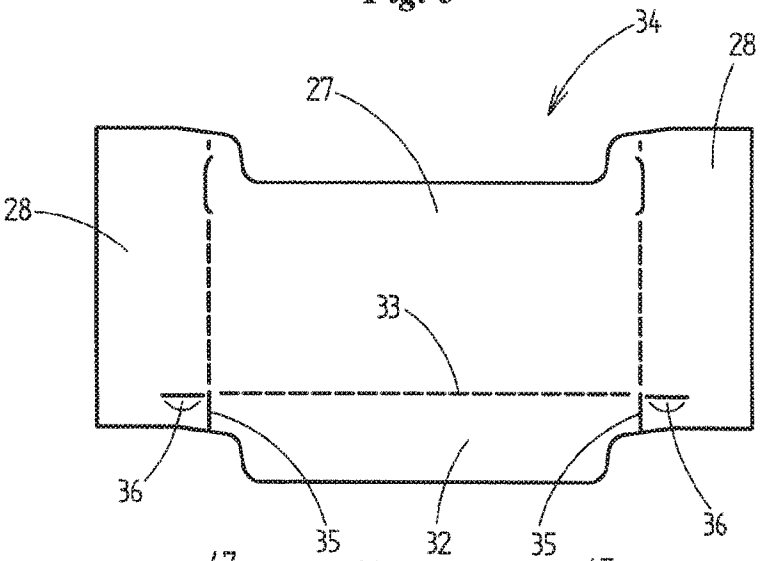
FIG. 5 shows a blank for the collar.

The bottom flap 32 is formed by folding a corresponding blank 34 (FIG. 5). In this case, the bottom flap 32 is delimited in relation to the collar front wall by means of the line joint 33. The bottom flap 32 is delimited in relation to the adjacent collar side walls 28 by punched cuts 35. The bottom flap 32 is folded by approximately 90° in relation to the collar front wall 27 or is pivoted about the line joint 33 so that it extends in the direction of the rear wall 12 of the box part transversely with respect to the collar front wall 27.

The bottom flap 32, folded in this manner, is held in the folded position, on the one side, by bearing projections 36 as bearing elements which are realized in the collar side walls 28 and, on the other side, by a bearing arrangement on a filling piece 37 which is arranged between the cigarette groups 29 or cigarette blocks 31 and the rear wall 12 of the box part 11 and compensates for a shallower depth of the cigarette groups 29 or cigarette blocks 31.

The bearing projections 36 can be realized as a result of punching and embossing in or on the collar side walls, for example in the form of hollow sphere dome portions which support the bottom flap 32 at the bottom. Other types of bearing elements are also conceivable within the framework of the invention.

The filling piece 37 comprises an opening 38 for the bearing arrangement of the bottom flap 32. A lower edge of the opening 38, in this case, serves as support edge as a further bearing element for the bottom flap 32. In this case, the bottom flap 32 rests on the support edge and projects through the opening 38 in the direction of the rear wall 12 of the box part 11.

The opening 38 itself is formed in the present case by a pivotable flap 39 which is delimited at the side and the bottom by punched cuts and is connected to a front wall 41 of the filling piece 37 at the top by means of a line joint 40. As an alternative to this, it is also conceivable, for example, for the opening 38 to be formed completely by punching.

The filling piece 37 abuts against the rear side of the cigarette groups 29 or cigarette blocks 31 by way of the front wall 41. In addition, the filling piece 37 has side walls 42 and an end wall 43 which extend in the direction of the rear wall 12 of the box part 11 proceeding from the front wall 41. The filling piece 37 has neither a rear wall nor a bottom wall and rests on the bottom wall 14 of the box part 11 by way of the side walls 42. At the top, the filling piece 37 extends to the upper end of the collar 26 and of the cigarette groups 29 or cigarette blocks 31. To the side, the side walls 42 abut against the inside of the collar side walls 28.

Figure 6:
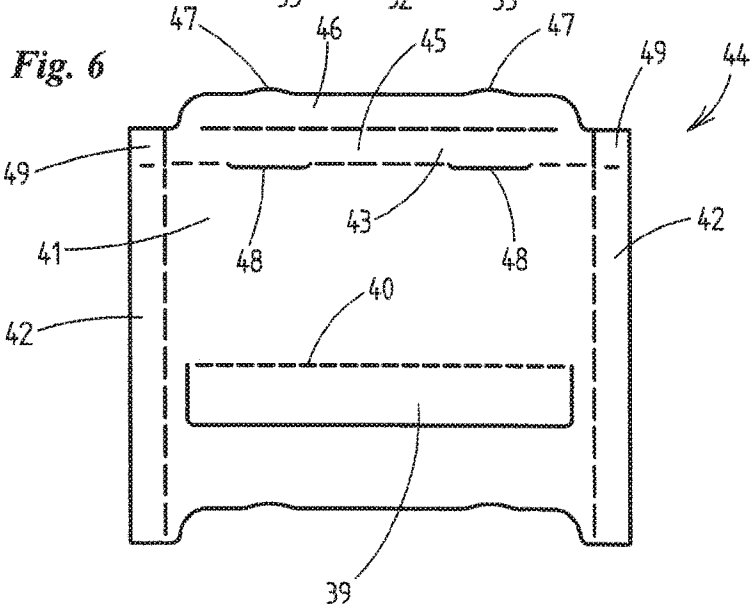
FIG. 6 shows a blank for the filling piece.

The filling piece 37 is produced by folding a corresponding blank 44 (FIG. 6) produced from packing material. One special feature is with regard to a head flap 45 which forms the end wall 43 and is secured by a tuck flap 46 in the folded position. To this end, tuck plates 47 of the tuck flap 46 are inserted into tuck slots 48 in the front wall 41. Corner tabs 49 as an extension of the side walls 42 are also held by the tuck flap 46.

Figure 4:
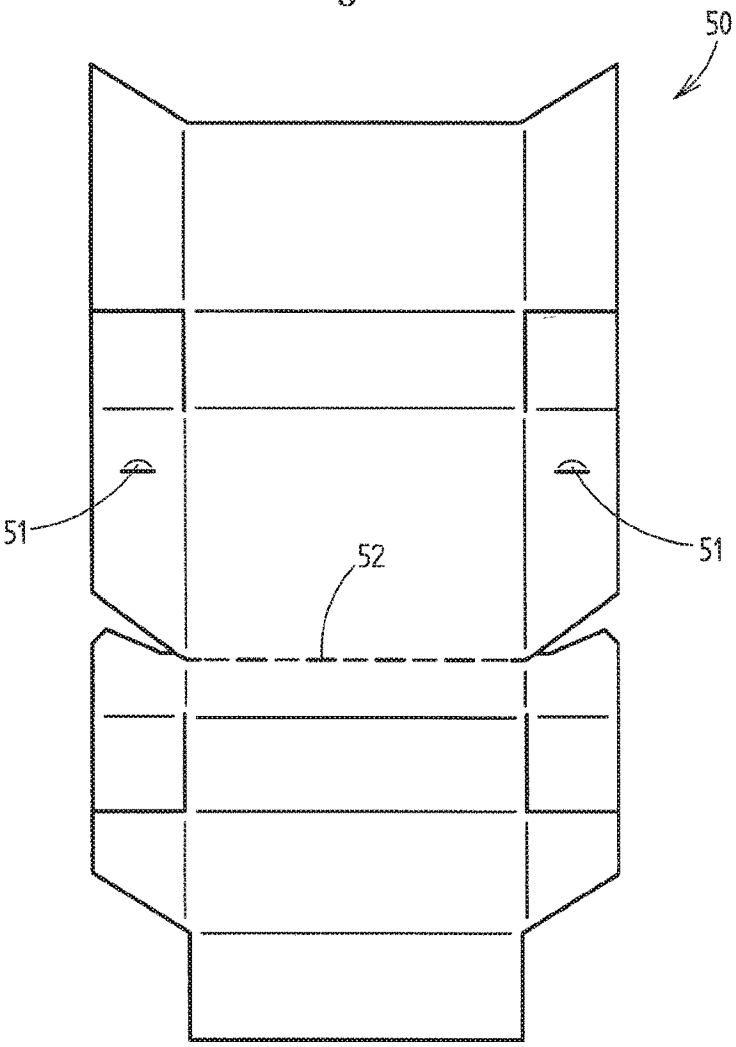
FIG. 4 shows a blank for the pack.
Figure 8:
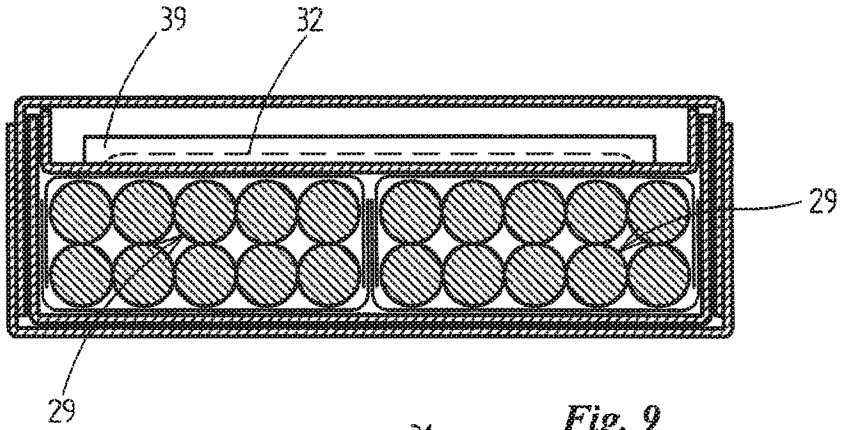
FIG. 8 shows a horizontal section through the pack along cutting line VIII-VIII in FIG. 1.

FIG. 4 shows a substantially usual blank 50 for the hinge-lid-type pack 10. One special feature is with regard to the arrangement of further bearing projections 51 as bearing elements in each case on an inner side tab. These serve for supporting the collar 26 or the collar side walls 28 at the bottom.

Figure 9:
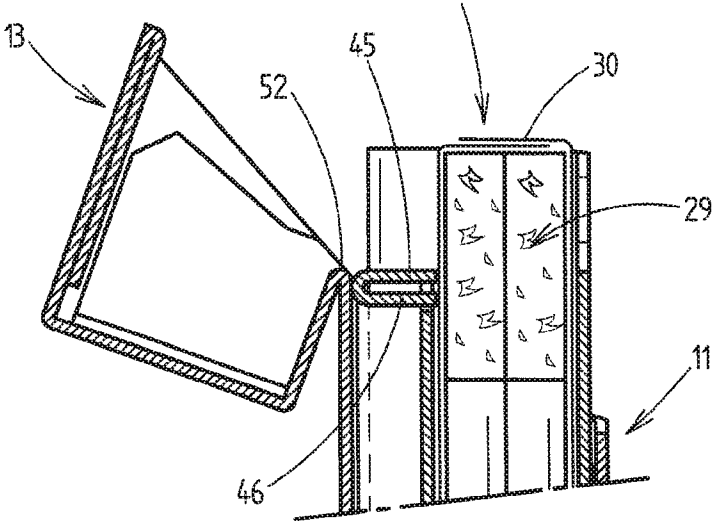
FIG. 9 shows a representation corresponding to FIG. 7 of a variant of the first exemplary embodiment.
Figure 7:
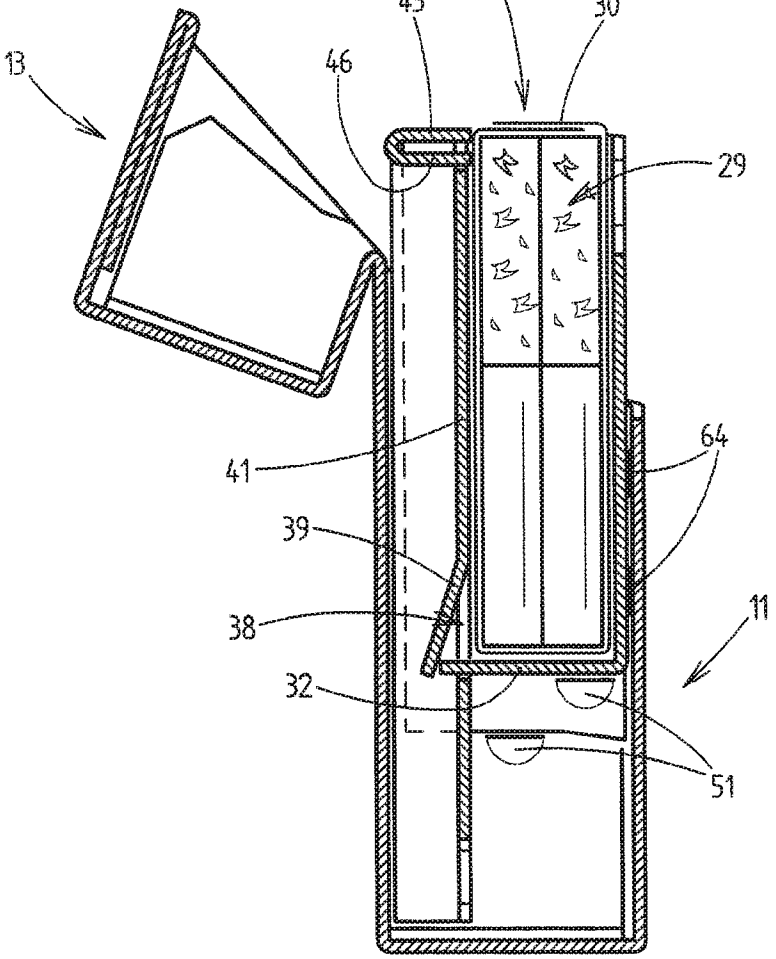
FIG. 7 shows a vertical section through the pack along cutting line VII-VII in FIG. 1.
Figures 10, 11, 12:
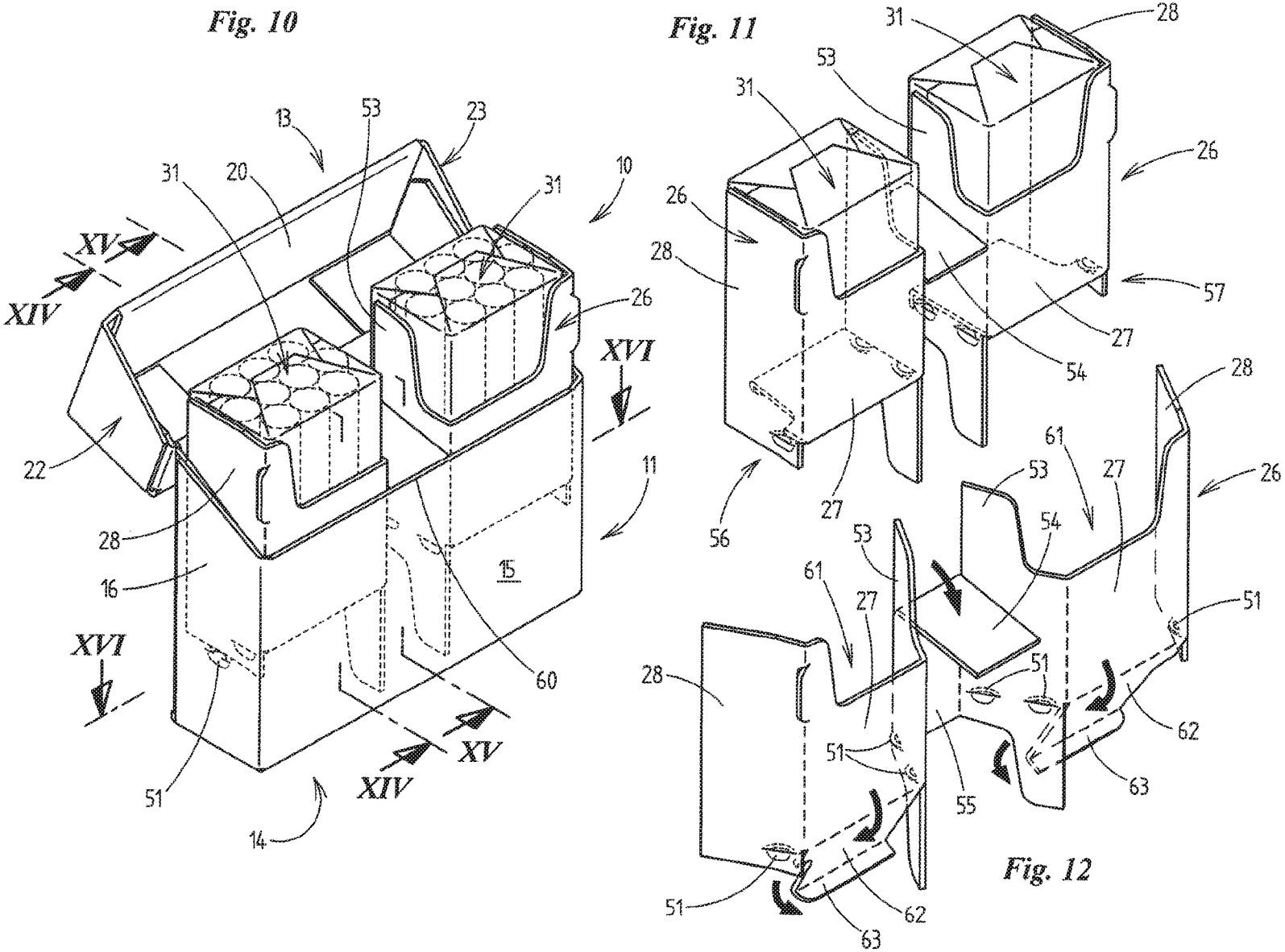
FIG. 10 shows a spatial representation of a second exemplary embodiment of a pack for cigarettes with the lid open.
FIG. 11 shows a spatial representation of the collar and the cigarette groups of the pack according to FIG. 10.
FIG. 12 shows a schematic representation of the folding operation for the collar according to FIGS. 10 and 11.
Figure 14:
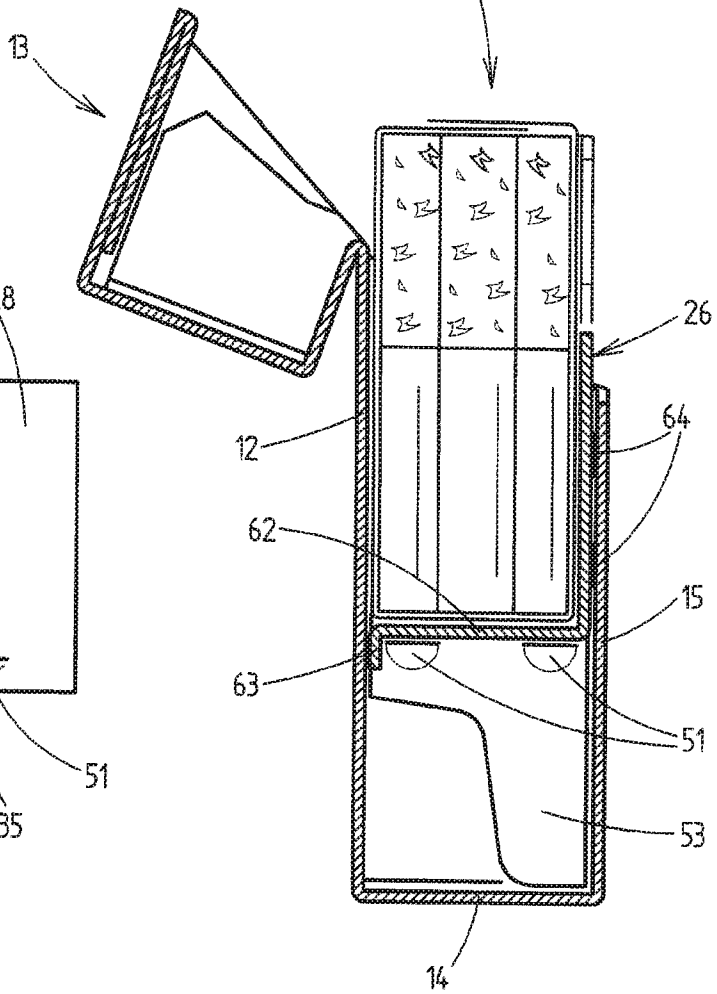
FIG. 14 shows a vertical section through the pack along cutting line XIV-XIV in FIG. 10.

FIG. 9 shows a variant of the first exemplary embodiment where the end wall 43 is not arranged at the top at the level of the top side of the cigarette groups 29 or cigarette blocks 31 but at the level of the line joint 52 between the box part 11 and the lid 13.

In the second exemplary embodiment according to FIGS. 10 to 16, two cigarette groups 29 or cigarette blocks 31 are provided, the width of which together is realized so as to be smaller than the width of the interior of the box part 10. With regard to the height, the length of the cigarettes is shorter than usual, corresponding to the first exemplary embodiment.

To compensate for the smaller width of the two cigarette groups 29 or cigarette blocks 31, a collar 26, designed in a particular manner, is used which is formed from multiple portions or fold tabs. Each of the two cigarette groups 29 or cigarette blocks 31 is surrounded on three sides by the collar 26, namely in the region of the front wall 15 by a collar front wall 27 and in the region of the side walls 16, 17 by outer collar side walls 28. In addition, inner collar side walls 53 are provided which extend along side faces of the cigarette groups 29 or cigarette blocks 31 which face one another and are arranged spaced apart from one another. A support member 54, which is formed from a fold tab of the collar 26, is arranged between the two inner collar side walls 53. In addition, the two inner collar side walls 32 are connected by a connecting flap 55.

An outer collar side wall 28, a collar front wall 27 and an inner collar side wall 53 each form a portion 56, 57 of the collar. The two portions are connected together by the connecting flap 55.

The width of the connecting flap 55 corresponds to the width of the support member 54, which is formed from the material of the collar 26 by punched cuts 58 and is connected to an upper end of the connecting flap 55 so as to be pivotable about a fold line 59.

During the production of the pack 10, the two cigarette groups 29 or cigarette blocks 31 are each wrapped in a portion 56, 57 of the collar 26 and the support member 54 is pivoted transversely with respect to the plane of the connecting flap 55. In said configuration, the inner collar side walls 53 abut against the free longitudinal edges of the support member 54 and bridge the distance between the two cigarette groups 29 or cigarette blocks 31 so that the smaller width of the cigarette groups 29 or cigarette blocks 31 together is compensated for by the support member 54 of the collar 26.

A further special feature is that the support member 54 is arranged such that the consumer or user is not able to see into the gap or space between the two cigarette groups 29 or cigarette blocks 31 when the pack is opened.

In the present case, the support member 54 is arranged approximately at the level of a closing edge 60 of the box part 11 and extends substantially horizontally or parallel to the bottom wall 14. The length of the support member 54, in this case, corresponds approximately to the corresponding dimension of the collar side walls or of the corresponding depth of the interior of the box part 11 so that the cavity extending in the box part 11 between the two cigarette groups 29 or cigarette blocks 31 is covered at the top.

Figure 15:
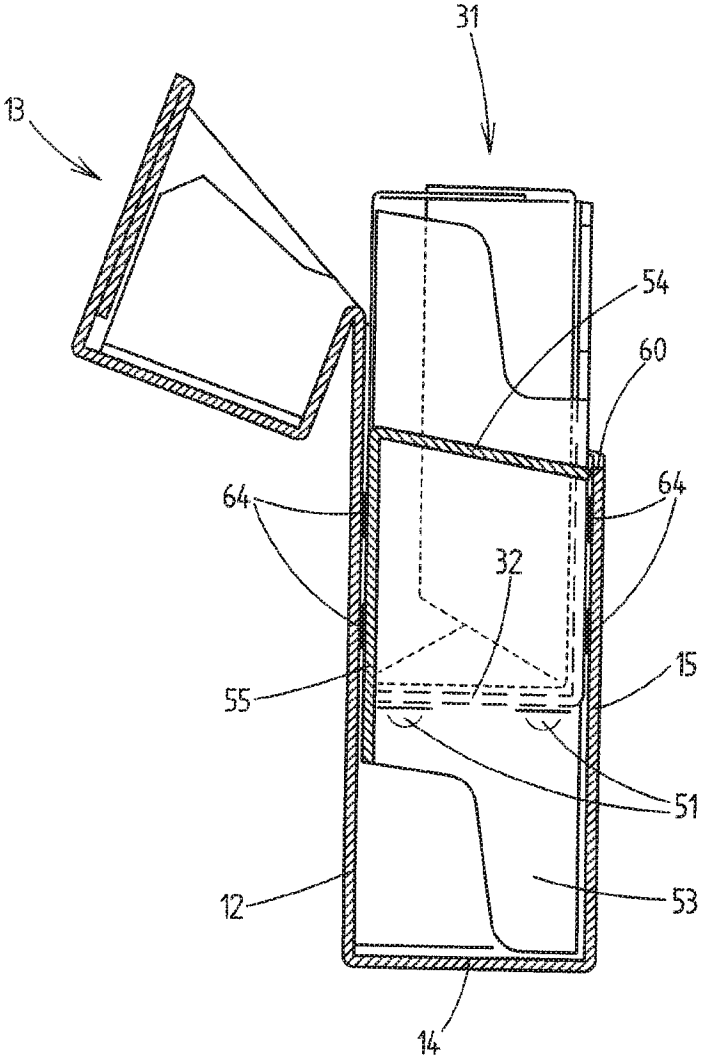
FIG. 15 shows a vertical section through the pack along cutting line XV-XV in FIG. 10.

It can be seen in FIG. 15 that the support member 54 is arranged in a slightly inclined manner and falls away slightly in the direction of the closing edge 60. Correspondingly, the support member 54 has to be realized somewhat longer than the depth of the interior of the box part 11. An edge of the support member 54 adjacent to the closing edge 60 is able to abut against the inside of the front wall 15 and be held in a non-positive and/or positive locking manner.

A further special feature relates to the arrangement of otherwise usual recesses 61 in the region of the top side of the collar 26 for the removal of cigarettes. Said recesses 61 each extend above the corner in the region of the collar front walls 27 and of the inner collar side walls 53 which connect thereto.

To support the cigarette groups 29 or cigarette blocks 31, a bottom flap 62 is arranged, as in the first exemplary embodiment, as an extension of the collar front wall 27 which, once again, is supported by bearing projections 51 on the collar side walls 28, 53. The bottom flaps 62 are each supported on the inner collar side walls 53 by two bearing projections 51 and on the outer collar side walls 28 by one bearing projection 51.

In contrast to the first exemplary embodiment, a filling piece has been omitted so that the bottom flaps 62 extend continuously up to the rear wall 12 of the box part 11. A support flap 63 abuts against said rear wall, said support flap extending connecting to the bottom flap 62 and extending in the direction of the bottom wall 14 of the box part 11 folded by 90° in relation to said bottom flap.

The collar 26 rests on the bottom wall 14 of the box part by way of the inner collar side walls 53, whereas the outer collar side walls 28 are mounted by means of bearing projections 51 in the region of the inner side tabs of the side walls 16, 17 of the box part, as in the first exemplary embodiment.

As in the first exemplary embodiment, the collar 26 can be fastened by means of glue (dots) 64 to the inside of the front wall 15 and/or of the rear wall 12 and/or of the side walls 16, 17 of the box part 11.

Figure 13:
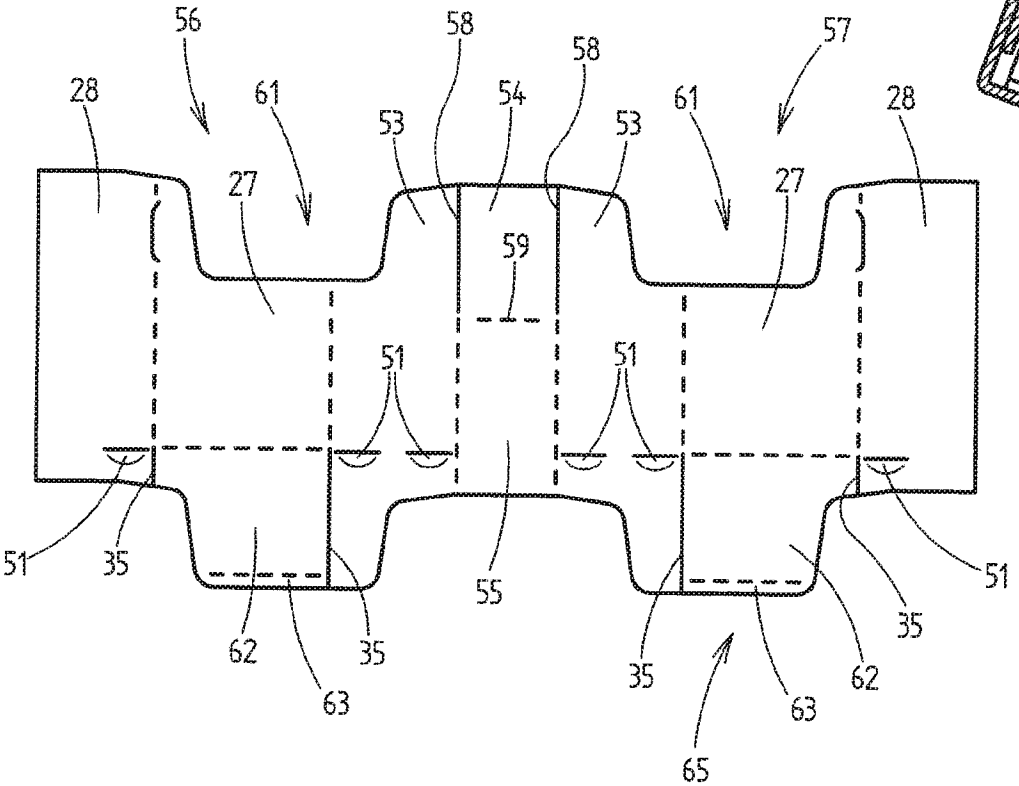
FIG. 13 shows a blank for the collar according to the FIGS. 10 to 12.
Figure 16:
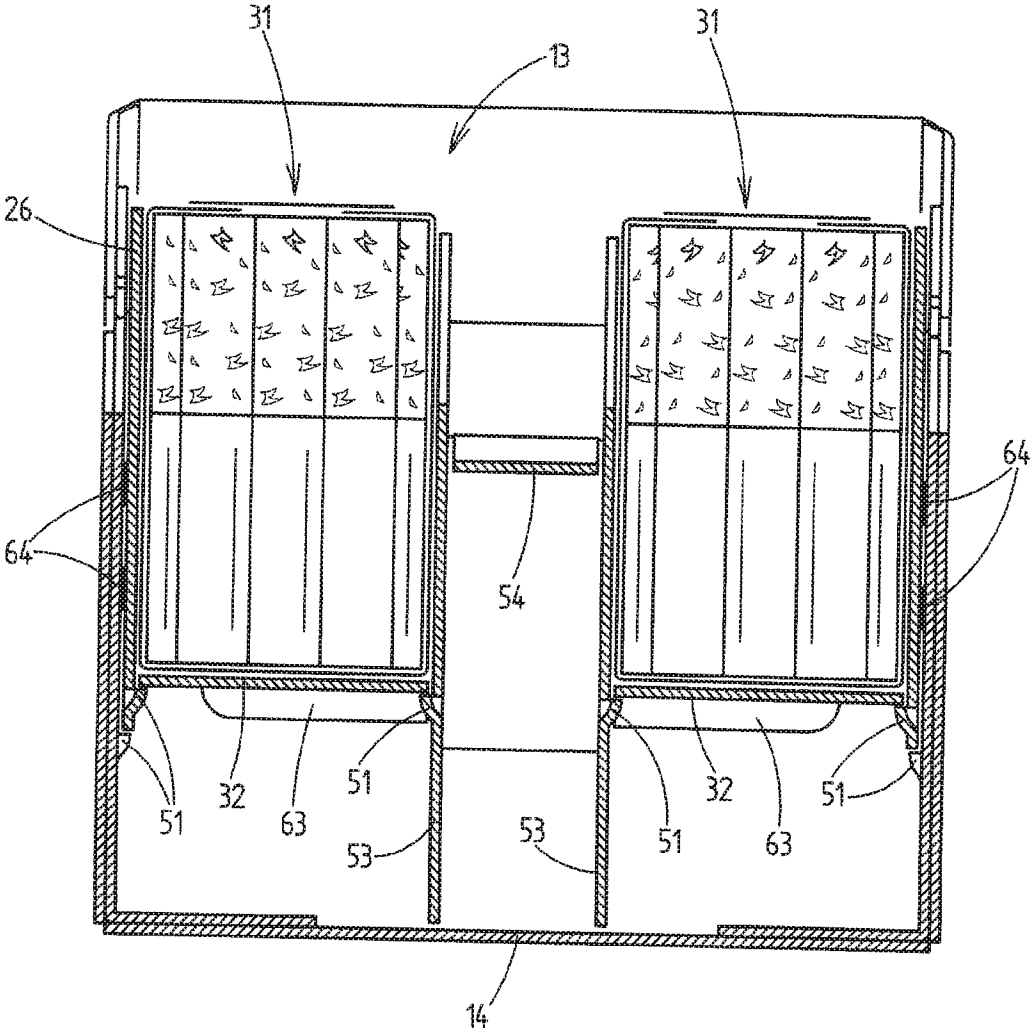
FIG. 16 shows a vertical section through the pack along cutting line XVI-XVI in FIG. 10.

FIG. 13 shows a corresponding blank 65 for such a collar 26.

Figure 18:
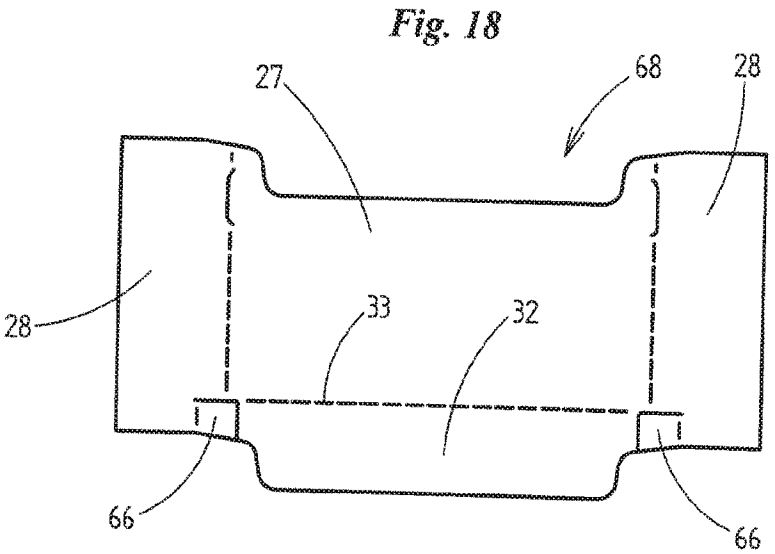
FIG. 18 shows a blank for a collar of the pack according to FIG. 17.
Figure 19:
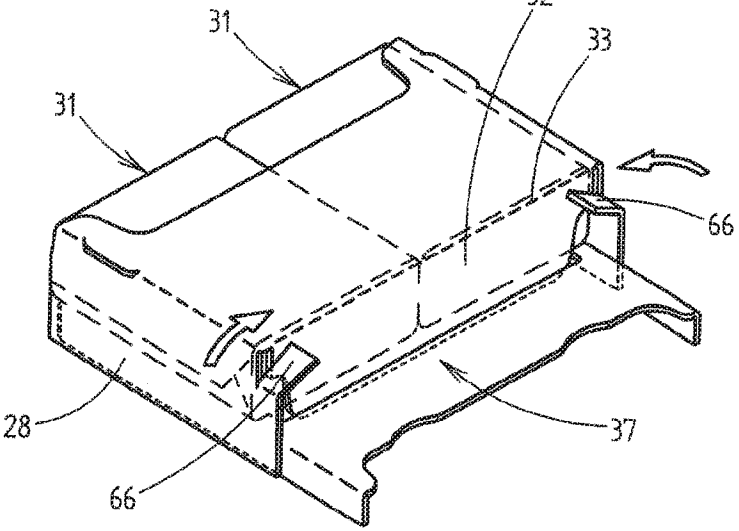
FIG. 19 shows a spatial representation of a pack content with filling piece and collar of the pack according to FIG. 17.
Figure 17:
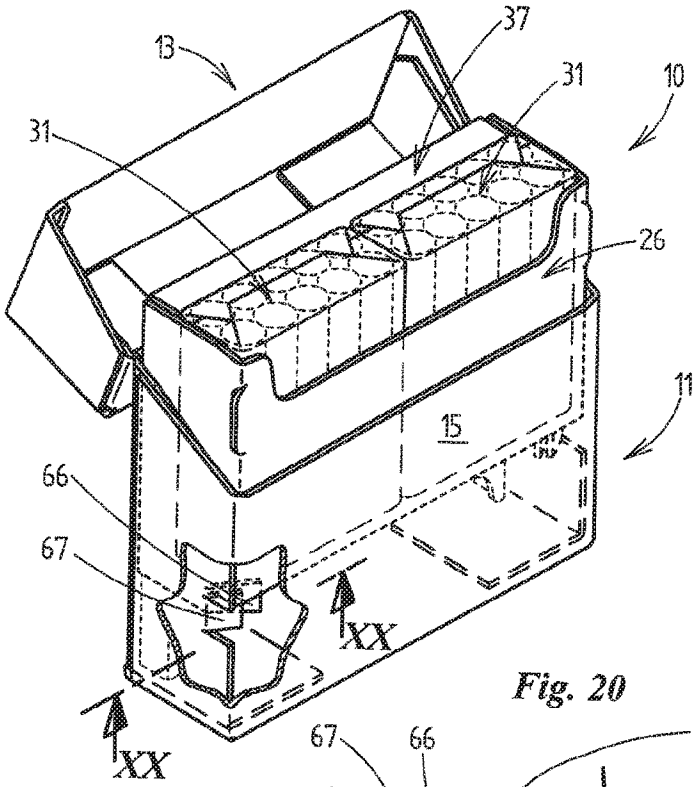
FIG. 17 shows a spatial representation of a third exemplary embodiment of a pack for cigarettes with the lid open.

The third and last exemplary embodiment according to FIGS. 17 to 19 is substantially comparable to the first exemplary embodiment. A difference exists, however, with regard to the bottom flap 32 being supported at the side. This is not effected by means of embossed bearing projections 51, as in the first two exemplary embodiments, but by means of support tabs 66, which are realized at the lower end of the collar side walls 28 and are able to be pivoted such that they are situated below the bottom flap 32 and support it.

In addition, corresponding support tabs 67, which are correspondingly pivoted and consequently support the collar 26 as a whole at the bottom, are also provided on the inner side tabs of the side walls 16, 17. The collar 26 is secured in its position in this way and does not have to be run up to the bottom wall 14 of the box part 11. However, it would also be conceivable to dispense with the support tab 66 and to run the collar 26 up to the bottom wall 14.

Figure 20:
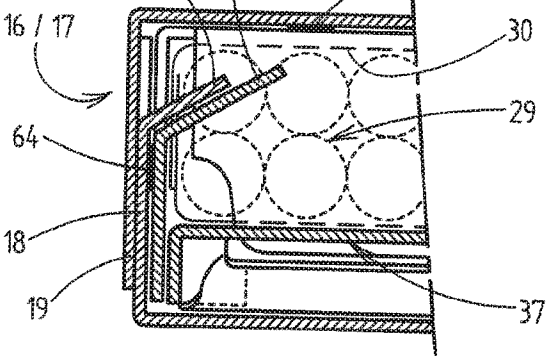
FIG. 20 shows a partial horizontal section through the pack along cutting line XX-XX in FIG. 17.

FIG. 20 shows that the pivoted support tabs 66, 67 abut against one another laterally and are arranged in the corresponding position on the collar 26 and the side walls 16, 17.

FIG. 18 shows a corresponding blank 68 for said variant of the collar 26.

LIST OF REFERENCES

10 Pack
11 Box part
12 Rear wall
13 Lid
14 Bottom wall
15 Front wall
16 Side wall
17 Side wall
18 Side tab
19 Side tab
20 Front wall
21 Rear wall
22 Side wall
23 Side wall
24 Side tab

25 Side tab
26 Collar
27 Collar front wall
28 Collar side wall
29 Cigarette group
30 Inner blank
31 Cigarette block
32 Bottom flap
33 Line joint
34 Blank (collar)
35 Punched cut
36 Bearing projection
37 Filling piece
38 Opening
39 Pivotable flap
40 Line joint
41 Front wall (filling piece)
42 Side wall
43 End wall
44 Blank (filling piece)
45 Head flap
46 Tuck flap
47 Tuck plate
48 Tuck slot
49 Corner tab
50 Blank (pack)
51 Bearing projection
52 Line joint
53 Collar side wall
54 Support member
55 Connecting flap
56 Portion
57 Portion
58 Punched cut
59 Fold line
60 Closing edge
61 Recess
62 Bottom flap
63 Support flap
64 Glue
65 Blank
66 Support tab
67 Support tab
68 Blank (collar)

What is claimed is:

1. A pack for rod-shaped objects, having a box part (11) which is delimited by at least one front wall (15), one rear wall (12), side walls (16, 17) and one bottom wall (14), wherein the box part (11) serves for receiving at least one cuboid group of rod-shaped objects wrapped in an inner blank (30) and wherein the pack (10) comprises predefined dimensions with regard to the width, the depth and the height, and at least one dimension of the at least one group of rod-shaped objects is smaller than a corresponding dimension of the interior of the box part (11) so that the at least one group of rod-shaped objects does not fill out the interior of the box part (11) with reference to the at least one dimension of the at least one group of rod-shaped objects that is smaller than a corresponding dimension of the interior of the box part (11), and wherein a collar (26) is arranged in the box part (11), consisting of at least one collar front wall (27), which abuts against the front wall (15) of the box part (11), and collar side walls (28) which are arranged adjacent to side walls (16, 17) of the box part (11), the box part (11) comprising:

a) at least one bottom flap (32) of the collar (26), which extends directed transversely to the at least one collar front wall (27) as a bottom-side support of the at least one group of rod-shaped objects, the at least one bottom flap (32) being arranged so that the collar (26) serves for compensating for a shallower height of the group of rod-shaped objects, the at least one bottom flap (32) being connected in an articulated manner to the at least one collar front wall (27) at a lower edge of the at least one collar front wall (27), and the at least one bottom flap (32) being held on the collar side walls (28) in a position directed transversely to the at least one collar front wall (27) by bearing projections (51) impressed in the material of the collar side walls (28) of the at least one bottom flap (32) opposite the side edges;

b) the or each group of rod-shaped objects further comprises a shallower depth than the interior of the box part (11), and wherein the smaller dimension of the group of rod-shaped objects is compensated for by a filling piece (37) produced by folding a separate blank which is arranged between the or each group of rod-shaped objects and a rear wall (12) of the box part (11); and c) the filling piece (37) serves as a bearing element for the at least one bottom flap (32) of the collar (26) and comprises an opening (38) for a bearing arrangement of the at least one bottom flap (32), wherein a lower edge of the opening (38) serves as a support edge and further bearing element for the at least one bottom flap (32).

2. The pack as claimed in claim 1, further comprising a front wall (41) of the filling piece (37), the front wall (41) abutting against a rear side of the or each group of rod-shaped objects, the front wall (41) comprising a pivotable flap (39), wherein the at least one bottom flap (32) projects into an opening (38) formed by the flap in the front wall (41) and is supported on a horizontal edge of the opening (38).

3. The pack as claimed in claim 1, wherein the filling piece (37) is formed from a folded blank (44) produced from packing material and comprises a front wall (41), an upper end wall (45) and side walls (42) and does not comprise a rear wall or a bottom wall, and wherein the filling piece (37) has a height that corresponds substantially to a corresponding dimension of the box part (11) so that the filling piece (37) stands upright on a bottom wall (14) of the box part (11), and wherein the pivotable flap (39) for forming an opening (38) with the bearing projection for the at least one bottom flap (32) is realized in the front wall (41) of the filling piece (37).

4. The pack as claimed in claim 1, wherein the at least one bottom flap (32) extends substantially over the entire width of the interior of the box part (11) below the or each group of rod-shaped objects.

5. The pack as claimed in claim 1, wherein the at least one bottom flap (32) extends substantially over the entire depth of the interior of the box part (11) between the front wall (15) of the box part (11) and the rear wall (12) of the box part (11) or of the front wall (41) of the filling piece (37).

* * * * *